United States Patent [19]

Zweig

[11] 4,224,397

[45] * Sep. 23, 1980

[54] CONTINUOUS TONE DIAZO MATERIAL

[75] Inventor: Gilbert Zweig, Barrington, R.I.

[73] Assignee: Trans World Technology Laboratories Inc. (TWT Labs, Inc.), Fiskeville, R.I.

[ * ] Notice: The portion of the term of this patent subsequent to Apr. 10, 1996, has been disclaimed.

[21] Appl. No.: 6,724

[22] Filed: Jan. 26, 1979

Related U.S. Application Data

[62] Division of Ser. No. 806,100, Jun. 13, 1977, Pat. No. 4,148,646.

[51] Int. Cl.[2] ..... G03C 1/60; G03C 1/78

[52] U.S. Cl. ..... 430/157; 430/148; 430/159; 430/160; 430/172; 430/176; 430/177

[58] Field of Search ..... 96/91 R, 75, 49

[56] References Cited

U.S. PATENT DOCUMENTS

| | | | |
|---|---|---|---|
| 2,603,564 | 7/1952 | Maxcy | 96/75 |
| 2,793,118 | 5/1957 | Sanders et al. | 96/91 R |
| 3,069,268 | 12/1962 | Herrick | 96/75 |
| 3,365,296 | 1/1968 | Cox et al. | 96/75 |
| 3,484,241 | 12/1969 | Evleth et al. | 96/75 |
| 3,525,618 | 8/1970 | Keller et al. | 96/75 |
| 3,615,475 | 10/1971 | Skarvinko | 96/75 |
| 3,661,591 | 5/1972 | Reed | 96/75 |
| 3,679,415 | 7/1972 | McNally | 96/75 |
| 3,836,369 | 9/1974 | Looney et al. | 96/75 |
| 3,996,056 | 12/1976 | Muller | 96/75 |
| 4,148,646 | 4/1979 | Zweig | 96/75 |

OTHER PUBLICATIONS

Muller, P., "Precoating of Diazotype Paper", *Tappi*, 8/1965, pp. 55A–59 A.

*Primary Examiner*—Charles L. Bowers

*Attorney, Agent, or Firm*—Birch, Stewart, Kolasch & Birch

[57] ABSTRACT

A diazotype material useful for making duplicates of continuous tone originals, such as X-ray films, comprising a transparent film support having a coating of a layer thereon consisting essentially of at least two light-sensitive diazo compounds having different photolysis rates, couplers for the diazo compounds, an ultraviolet radiation absorbing material and homogeneously distributed in the layer at least about 7% by weight, based on the weight of lacquer, of an inert particulate material such as silica. The use of this material makes it possible to approximate a logarithmic photolysis, thereby providing sufficient linearity in the corresponding characteristic curve to achieve the desired duplicating results.

8 Claims, 8 Drawing Figures

CONTINUOUS TONE DIAZO MATERIAL

This application is a divisional, of copending application Ser. No. 806,100, filed on June 13, 1977 now U.S. Pat. No. 4,148,646.

Figure 1:
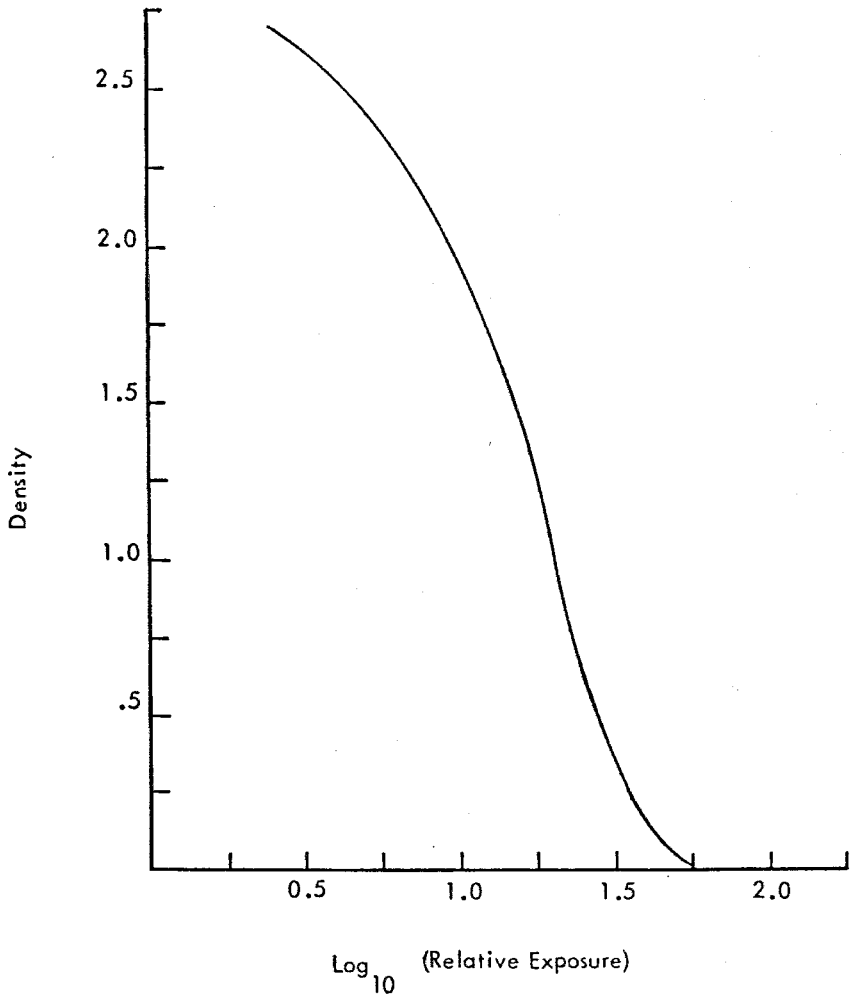

This invention relates to a diazo system and process for providing duplicates of continuous tone originals such as X-ray films. p It has long been recognized in the art that the sensitometry of the diazotype process does not lend itself, normally, to the duplicating of continuous tone originals (M. S. Dinaburg, "Photosensitive Diazo Compounds", Focal Press, page 147 (1964)). This is evident when a typical characteristic curve of diazo imagery is examined. Thus, in the typical characteristic curve for diazo materials, such as shown in FIG. 1, in addition to a high contrast or gamma, the linear portion of the characteristic curve is extremely abbreviated. However, in order to achieve good continuous tone imagery for densities of the order of 1.5 or greater, it is desirable to have a gamma in the range of 1 to 1.6. In addition, an extended linear portion of the characteristic curve is equally important. The present invention makes use of both of these parameters in providing an excellent and advantageous diazotype material for providing duplicates of continuous tone originals. Such duplicating is important, particularly in the medical field, so that a high and consistent quality of duplicates of originals, such as X-ray films, can be obtained, e.g., for examination and analysis by different medical practitioners or staff members.

Figure 2:
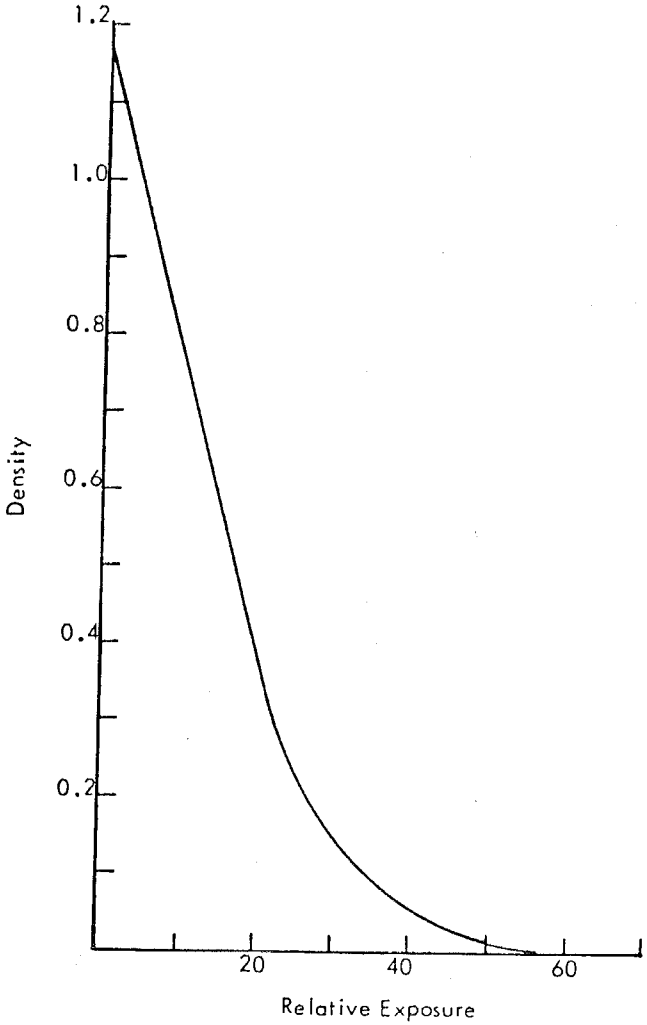

Herrick (Journal of the Optical Society of America, pp. 904–910, December, 1952) shows theoretically that for high initial actinic densities in diazo decomposition, the diazo density is a linear function of exposure. Typical photolysis curves of a diazo comound are shown in FIG. 2. These curves are expressed as density vs. exposure (or relative exposure) as compared to characteristic curves, where density is plotted as a function of log (relative exposure); compare FIGS. 1 and 2.

Figure 3:
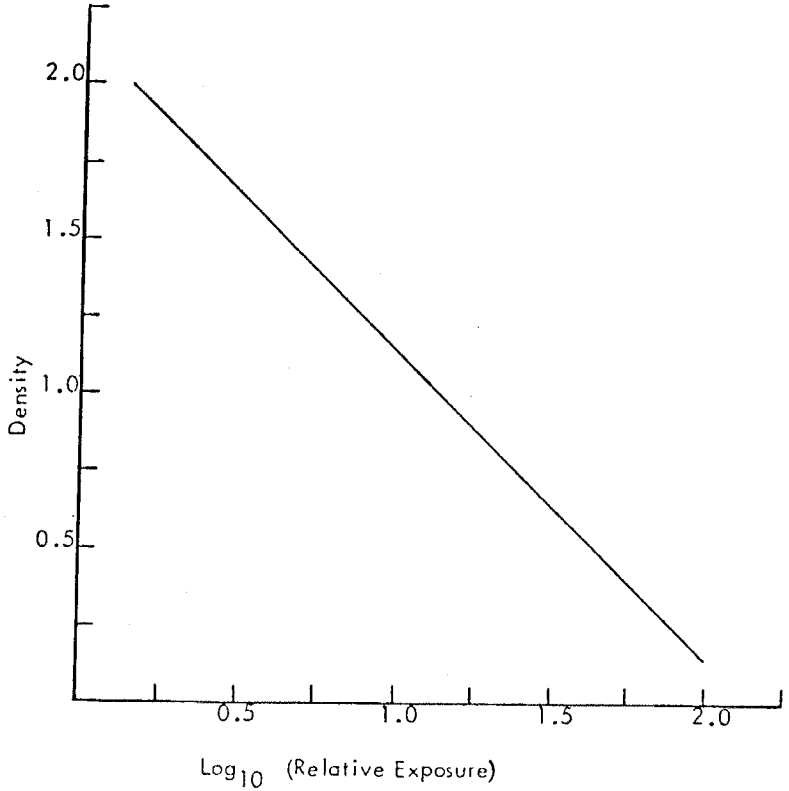

If one takes the photolysis curve of FIG. 2 and calculates its corresponding characteristic curve, the curve as shown in FIG. 1 is obtained. That is to say, when the photolysis curve is linear, as is intrinsic with a diazo compound, the characteristic curve does not lend itself to the production of good continuous tone characteristics. In order to provide such characteristics, an idealized characteristic curve having a lengthened linear portion such as shown in FIG. 3 is necessary. In this curve, a gamma of 1.0 between density values of 2.0 and 0.15 is observed. Thus, the governing linear equation for the logarithmic abscissa can be written as $$D=C+K\overline{E} \quad (1)$$

$$\text{where } \overline{E}=\log E \quad (2)$$

and where D is density, E is exposure and C and K are constants. In terms of the photolysis curve needed to provide a linear characteristic curve, the photolysis curve can be described by the following equation:

$$D=C+K\log E \quad (3)$$

Figure 4:
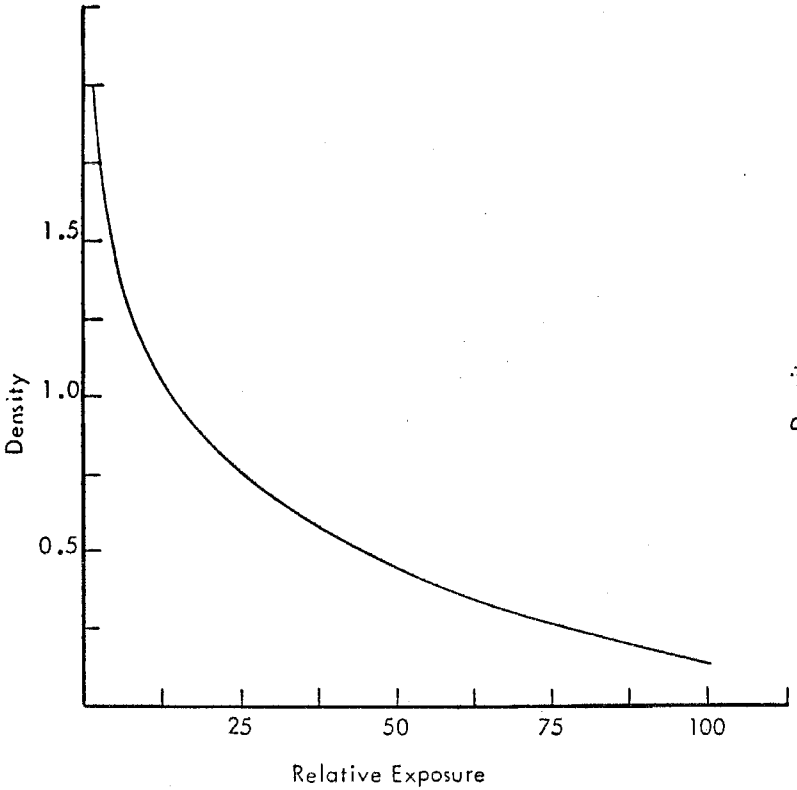

Thus, the important point to note is that in order to achieve a linear characteristic curve, a logarithmic photolysis must be simulated. This is shown in FIG. 4. Achieving a linear characteristic curve is thus accomplished by approximating a logarithmic photolysis curve. This has been accomplished unknowingly in the prior art in a number of ways, without recognizing the correlation between the desired characteristic curve and the required photolysis curve.

Figure 5:
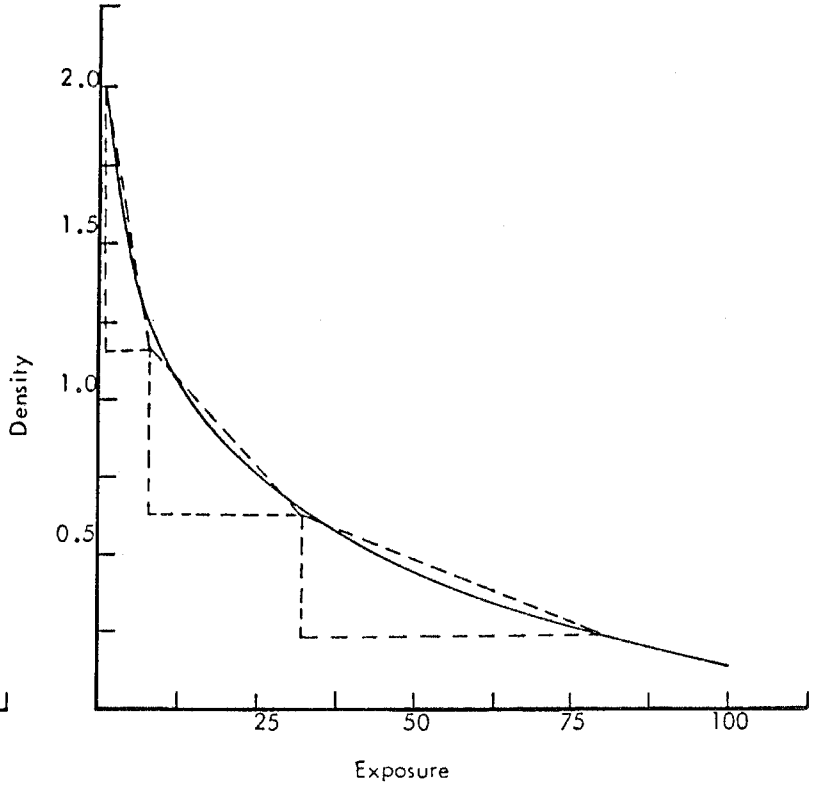

One way, illustrated in FIG. 5, is to approximate the logarithmic photolysis by the linear photolysis of a multi-diazo system (three diazos in this particular case). In this procedure varying diazo concentrations and photolysis rates can be combined to achieve the final approximation. A homogeneous mixture of multiple diazo compounds coated in a single layer as well as multiple diazo compounds coated in separate layers have been employed in order to achieve the desired effect. In some cases, the photolysis rate of particular diazos can be varied by the inclusion of ultraviolet radiation absorbing compounds having varying ultraviolet absorption spectra in the system. This was, in fact, the approach used in some of the results of past workers (U.S. Pat. Nos. 3,661,591, 3,069,268 and 2,793,118).

A second approach used in the art for simulating the logarithmic photolysis curve of FIG. 4 is to approximate it by an exponential photolysis of the following form:

$$D=D_o \exp(-aE) \quad (4)$$

where D is density, $D_o$ is the initial density, a is a constant and E is exposure.

Figure 6:
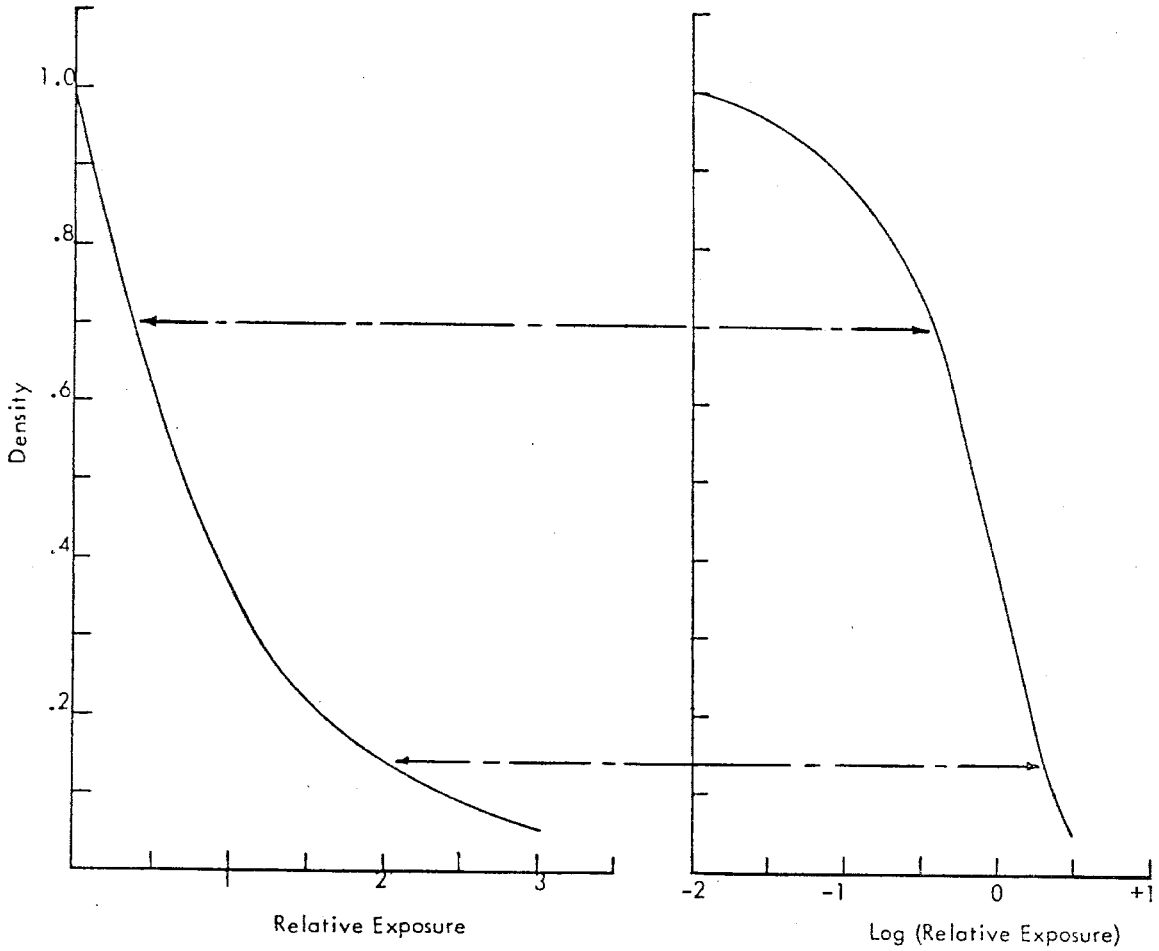

This is achieved by the bulk absorption of uniformly distributed non-photolyzable attenuating constituents in the diazo layer. Examples of such constituents are commercial ultraviolet absorbers, particulates and diazos whose products of decomposition themselves have ultraviolet absorbing properties. An example of an exponential photolysis is shown in FIG. 6. An approach of this type was used in an attempt to extend the tonal range of the diazo process by certain workers in the prior art (U.S. Pat. Nos. 2,378,583, 2,739,061 and 3,525,618). However, even with this approach, only an abbreviated linear portion in the corresponding characteristic curve is obtained.

Thus, all of these prior art attempts suffer from one disadvantage or another, either in complex preparations or processing or in less than acceptable duplicating results. This is particularly critical in medical applications where qualities at least equivalent to silver halide duplicates are required. However, because of the growing expense of silver halide systems, it is quite important to develop a procedure as a substitute therefor.

Accordingly, one of the objects of the present invention is to provide an effective and advantageous diazo system which enables the production of excellent duplicates of continuous tone originals.

Another object of the invention is to provide a procedure for obtaining duplicates of silver halide X-ray films.

These and other objects and advantages of the invention will become apparent to those skilled in the art from a consideration of the following specification and claims, taken in conjunction with the accompanying drawings.

Figure 7:
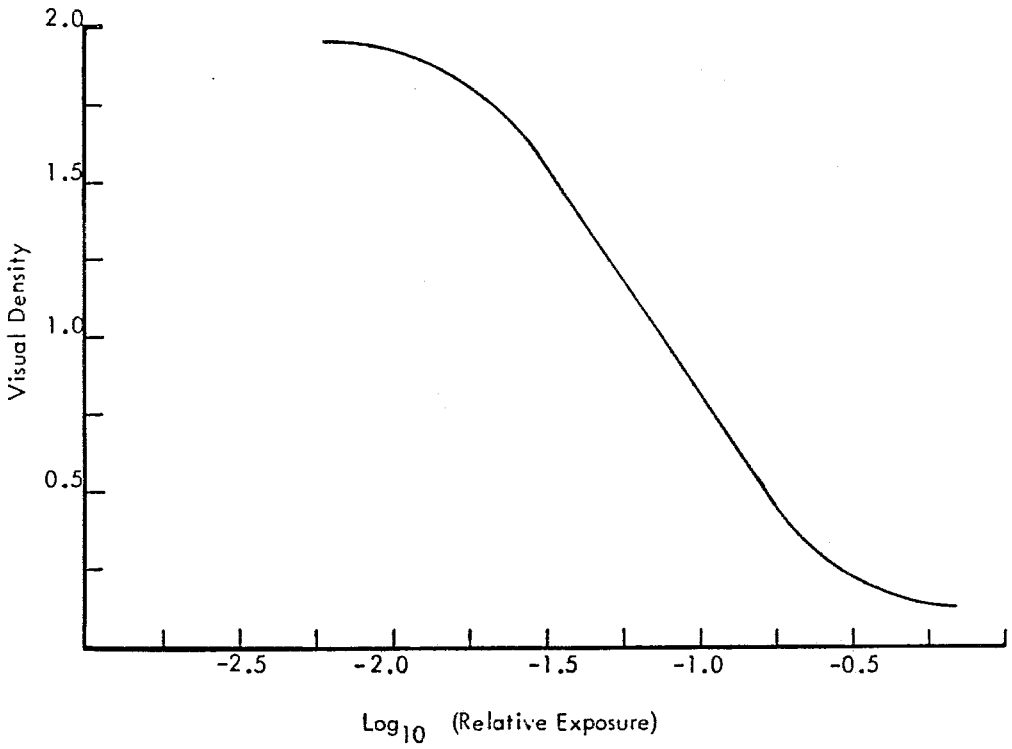
Figure 8:
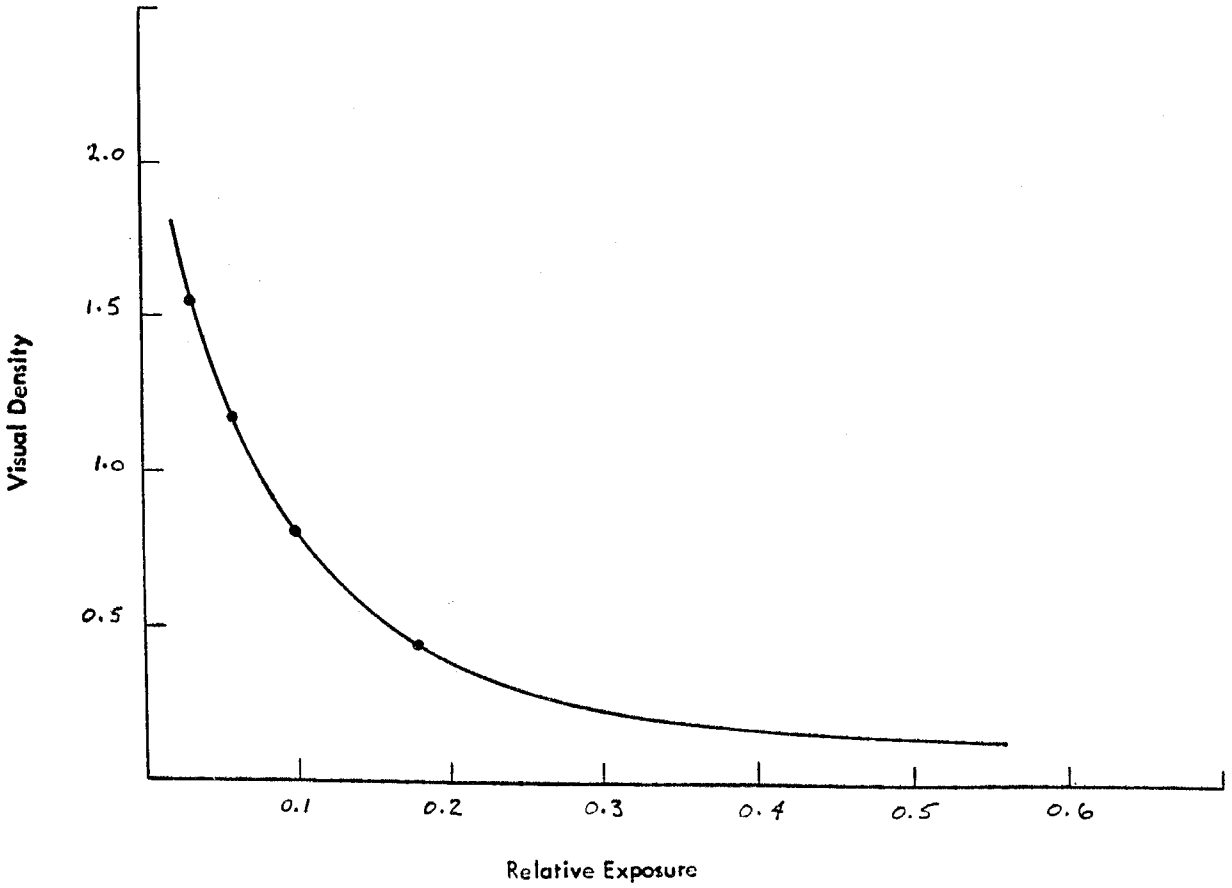

In accordance with the present invention, it has been found that a diazo system containing at least two light-sensitive diazo compounds with different photolysis rates and particular ultraviolet absorbers which selectively attenuate the actinic radiation with respect to one or more of the diazos in combination with a bulk, broad actinic radiation-absorbing, unreactive (inert) particulate material provides the necessary logarithmic photolysis needed to obtain the linear characteristic curve i.e., the resulting photolysis curve obtained by plotting the ultraviolet density of the undeveloped or latent image versus relative exposure is substantially congruent with respect to a logarithmic curve following the equation:

$$D=K+C \log E$$

where D is the ultraviolet density, E is the relative exposure and K and C are constants, for a range covering at least one density unit. The critical feature of the invention is the use of the bulk (homogeneous) inert particulate material in the system. By combining the bulk, exponential absorption effect of the particulates and a non-photolyzable ultraviolet radiation absorber with the logarithmic photolysis approximation of a multi-diazo system, the characteristic curve shown in FIG. 7 was actually obtained. An extended linear density range of 1.25 was observed in this particular case. FIG. 8 confirms that this particular characteristic curve has a photolysis curve exhibiting an excellent fit with the logarithmic function, $$D=-(1.48 \log_{10}E+0.67) \quad (5)$$

where D is density and E is relative exposure.

The support for the diazotype material is normally a transparent film of, for example, a polyester or cellulose acetate. This is particularly true with duplicates of X-ray photographs where such duplicates are almost always observed as transparencies. Suitable copies of X-ray films can, however, be produced on diazotype material having a paper support.

The support may, if desired, be pre-treated to facilitate adhesion of the light-sensitive layer. It may also be given a coating of lacquer before application of the light-sensitive layer. Alternatively, lacquer may be incorporated into the light-sensitive layer itself. However, the preferred embodiment is to use a system wherein a solvent solution of the diazo compounds, couplers and stabilizers is imbibed into a binder lacquer containing the bulk absorbers and optionally some blue dye such as Heliogen Violet, DuPont Oil Blue, Crystal Violet or Methyl Violet. Examples of suitable lacquers are cellulose acetate, cellulose acetate propionate, cellulose acetate butyrate, polyvinyl acetate and polyvinyl formal.

Examples of suitable light-sensitive diazonium compounds which may be employed in the system of the invention are:

p-diethylamino-2-ethoxybenzenediazonium fluoroborate;
2,5-diethoxy-4-morpholinobenzenediazonium fluoroborate;
p-diethylaminobenzenediazonium fluoroborate;
1-diazo-4-(N-hydroxyethyl-N-ethylamino)-benzene fluoroborate;
1-diazo-2-ethoxy-4-(N,N-diethylamino)-benzene fluoroborate;
1,diazo-2,5 -dimethoxy-4-morpholino-benzene fluoroborate;
1-diazo-4-(N,N-dimethylamino)-benzene fluoroborate;
1-diazo-3-methyl-4-ethylamino-benzene fluoroborate;
1-diazo-2,5-diethoxy-4-morpholino-benzene fluoroborate; and
1-diazo-4-(N,N-diethylamino)-benzene fluoroborate Examples of suitable couplers to be employed therewith are 2,3-naphthalenediol; naphthalene 2,3-dihydroxy-6-sulphinic acid; resorcinol; 4,4'-diresorcinol, acetoacetanilide; acetoacet-o-toluidide; chlororesorcinol; N,N-bis-β-hydroxyethyl-2-hydroxy-3-naphthoamide; N-(2'-methylphenyl)-2-hydroxy-3-naphthoamide; N-γ-morpholino-n-propyl-2-hydroxy-3-naphthoamide and N,N-bis-β-hydroxyethyl-2-hydroxy-3-naphthoamide.

Stabilizers for diazos are well known in the art and include substances such as tartaric acid, citric acid, sulfosalicylic acid, etc.

The bulk absorption in the diazo system of the invention results from the use of inert particulates such as silica, clays or pigments. Basically, in order to obtain the desired linear diazo characteristic curve by means of the bulk absorption in the diazotype system, the inert particulates must function to provide scattering sites in the diazo layer. Hence, even bubbles (vesicules) are suitable if homogeneously scattered. The amount of inert particulate employed must be at least about 7% by weight based on the amount of lacquer containing the particulate which is coated on the support. A lesser amount will not function suitably to give good quality duplicates of continuous tone originals. This is particularly true for duplicates of X-ray photographs. A suitable range of amount of inert particulate material is about 7% to about 20% by weight of particulate based on the weight of lacquer. The preferred particulate is silica.

Also important is the size of the inert particulate material employed. Generally, suitable results are obtained with inert particulates, such as inorganic pigments, having a particle size of up to approximately 50 microns. Advantageously, in order to achieve the best results, particulates within a size range of about 1 to 50 microns should be used.

Suitable particulates to be used in the invention include, as noted above, various clays and pigments such as silica, aluminum silicates, diatomaceous earths, magnesium silicates, barium sulfate, mica, etc.

Ultraviolet absorbers suitable for use in the diazo system of the invention include materials such as 7-diethylamino-4-methylcoumarin, substituted benzotriazoles such as 2(2'-hydroxy-5'-methylphenyl)benzotriazole (U.S. Pat. Nos. 3,004,896 and 3,189,615), p-methoxybenzylidenemalonic acid dimethyl ester, 2-hydroxy-4-methoxybenzophenone, etc.

It is also important to note that the diazotype material of the present invention is contained in a single layer on the support material and not in multiple layers as has been done in various prior art systems. Thus, the coating procedure for making the diazotype system of the invention is much less complex than would be required for multiple layers.

Development of the exposed diazotype material is carried out by procedures well known in the art. Thus, the exposed film is usually developed by means of ammonia vapors at a temperature of about 200°-300° F. in a conventional diazo developer apparatus.

The following examples are given merely as illustrative of the present invention and are not to be considered as limiting. Unless otherwise noted, the percentages therein and throughout the application are by weight.

EXAMPLE 1

A lacquer is prepared consisting of

| | | |
|---|---|---|
| (1) | ½ second Cellulose Acetate Butyrate | 20 g. |
| (2) | Polyvinyl Acetate-Polyvinyl Alcohol Copolymer | 1 g. |
| (3) | Toluol | 50 ml. |
| (4) | Acetone | 40 ml. |
| (5) | Syloid 72 (silica) | 1.7 g. |
| (6) | Synasol 190 (denaturated ethanol) | 12 ml. |

This mixture is ball milled for 4 hours and coated on a polyester film which has been treated with trichloroacetic acid and silica.

The lacquered film is then imbibed with the following formulation which contains two diazo compounds:

| | | |
|---|---|---|
| (1) | Methyl ethyl ketone | 40.4 g. |
| (2) | Synasol 190 | 47.9 g. |
| (3) | Formic Acid | 9.2 g. |
| (4) | p-morpholine aceto-acetanilid | 0.07 g. |
| (5) | 4-N:N-diethylaminobenzene diazonium . $BF_4$ | 0.76 g. |
| (6) | 4-N:N-diethylamino-2-ethoxybenzene diazonium . $BF_4$ | 0.76 g. |
| (7) | 7-diethylamino-4-methyl-coumarin (u.v. absorber) | 0.70 g. |
| (8) | 2-hydroxynaphthalene-3-carboxylic acid ethanol amide | 0.91 g. |
| (9) | Tartaric Acid | 2.40 g. |
| (10) | Resorcinol | 0.35 g. |

The 4-N:N-diethylaminobenzene diazonium.$BF_4$ in conjunction with the noted u.v. absorber exhibits a relative photolysis rate of 0.125. The 4-N:N-diethylamino-2-ethoxybenzene diazonium.$BF_4$ in conjunction with said u.v. absorber exhibits a relative photolysis rate of 0.037.

The film is exposed through a suitable original X-ray photograph on an Arkwright DGS 1400 vacuum frame printer for 20 seconds, high intensity and developed on an Arkwright Model 404 developer. Excellent duplicates of the original, suitable for medical standards, are obtained.

EXAMPLE 2

The following light-sensitive solution is imbibed into the same lacquered film as described in Example 1:

| | |
|---|---|
| Tartaric acid | 2.0 g. |
| Resorcinol | 0.3 g. |
| N-(2'-methylphenyl)-2-hydroxy-3-naphthoamide | 0.4 g. |
| N,N-bis-β-hydroxyethyl-2-hydroxy-3-naphthoamide | 0.5 g. |

-continued

| | |
|---|---|
| 1-diazo-4-(N,N-diethylamino)-benzene fluoroborate | 0.6 g. |
| 1-diazo-2-ethoxy-4-(N,N-diethylamino)benzene fluoroborate | 0.6 g. |
| 1-diazo-2,5-diethoxy-4-morpholinobenzene fluoroborate | 0.3 g. |
| 7-diethylamino-4-methyl-coumarin | 1.2 g. |
| dissolved in: | |
| Methyl ethyl ketone | 50 ml. |
| Synasol 190 | 50 ml. |

Excellent duplicates of X-ray photographs are obtained using the resulting diazotype material in the same manner as described in Example 1.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A diazotype material useful for making duplicates of continuous tone originals comprising a transparent film support and a layer coated thereon consisting essentially of a binder lacquer containing at least two diazonium compounds having different photolysis rates, at least one coupler for the diazonium compounds, a non-photolyzable ultraviolet radiation absorbing material, and homogeneously distributed in said layer at least about 7% by weight of a bulk, broad actinic radiation-absorbing, inorganic pigment, based upon the amount of lacquer.

2. A diazotype material in accordance with claim 1, wherein said layer contains about 7% to about 20% by weight of said inorganic pigment, based upon the amount of lacquer.

3. A diazotype material in accordance with claim 1, wherein said inorganic pigment is silica.

4. A diazotype material in accordance with claim 1, wherein said inorganic pigment has a particle size of up to approximately 50 microns.

5. A diazotype material in accordance with claim 1, wherein said inorganic pigment has a particle size of approximately 1 to 50 microns.

6. A diazotype material in accordance with claim 1, wherein the continuous tone original is a silver halide X-ray film.

7. A diazotype material in accordance with claim 1, wherein said lacquer further contains a blue dye.

8. A diazotype material in accordance with claim 1, wherein said film support has a blue tint.

* * * * *